US011852158B1

(12) United States Patent
Chen et al.

(10) Patent No.: US 11,852,158 B1
(45) Date of Patent: Dec. 26, 2023

(54) FAN AND IMPELLER

(71) Applicant: Acer Incorporated, New Taipei (TW)

(72) Inventors: Tsung-Ting Chen, New Taipei (TW); Wen-Neng Liao, New Taipei (TW); Cheng-Wen Hsieh, New Taipei (TW); Jau-Han Ke, New Taipei (TW); Kuang-Hua Lin, New Taipei (TW); Yu-Ming Lin, New Taipei (TW); Chun-Chieh Wang, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

(21) Appl. No.: 18/311,245

(22) Filed: May 3, 2023

(30) Foreign Application Priority Data

Mar. 7, 2023 (TW) ..... 112108250

(51) Int. Cl.
*F04D 29/32* (2006.01)
*F04D 29/52* (2006.01)
*F04D 19/00* (2006.01)

(52) U.S. Cl.
CPC ..... *F04D 29/325* (2013.01); *F04D 19/002* (2013.01); *F04D 29/522* (2013.01)

(58) Field of Classification Search
CPC ..... F04D 29/325; F04D 29/384; F04D 29/38; F04D 29/666; F04D 19/002; B64C 11/18
See application file for complete search history.

(56) References Cited

U.S. PATENT DOCUMENTS

| | | | | |
|---|---|---|---|---|
| 5,624,234 | A * | 4/1997 | Neely | F04D 29/326 416/189 |
| 6,994,523 | B2 * | 2/2006 | Eguchi | F04D 29/667 416/235 |
| 7,946,824 | B2 * | 5/2011 | Iwase | F04D 29/386 416/243 |
| 9,394,911 | B2 * | 7/2016 | Nakashima | F04D 29/384 |
| 9,435,345 | B2 * | 9/2016 | Otsuka | F04D 29/384 |
| 10,344,764 | B2 * | 7/2019 | Nakamura | F04D 29/002 |
| 10,519,978 | B2 * | 12/2019 | Gebert | F04D 29/384 |
| 10,550,855 | B2 * | 2/2020 | Arai | F04D 29/384 |
| 2004/0136830 | A1 * | 7/2004 | Eguchi | F04D 29/384 416/228 |
| 2008/0101964 | A1 * | 5/2008 | Iwase | F04D 29/386 416/223 R |
| 2013/0101420 | A1 * | 4/2013 | Nakashima | F04D 19/002 416/204 R |
| 2013/0156561 | A1 * | 6/2013 | Otsuka | F04D 19/002 415/185 |

* cited by examiner

*Primary Examiner* — Eldon T Brockman
(74) *Attorney, Agent, or Firm* — JCIPRNET

(57) ABSTRACT

A fan including a frame and an impeller is disclosed. The frame has an air inlet and an air outlet. The impeller is disposed in the frame and includes a hub and multiple blades. Each blade has a negative pressure surface facing the air inlet, a positive pressure surface facing the air outlet, a blade root, and a blade tip opposite to the blade root. In a first region extending from the blade root to the blade tip by a first length, the negative pressure surface and the positive pressure surface are respectively a convex arc surface and a plane. In a second region extending from the blade tip to the blade root by a second length smaller than the first length, the negative pressure surface and the positive pressure surface are respectively a convex arc surface and a concave arc surface or both are convex arc surfaces.

12 Claims, 4 Drawing Sheets

FAN AND IMPELLER

CROSS-REFERENCE TO RELATED APPLICATION

This application claims the priority benefit of Taiwan application serial no. 112108250, filed on Mar. 7, 2023. The entirety of the above-mentioned patent application is hereby incorporated by reference herein and made a part of this specification.

BACKGROUND

Technical Field

The invention relates to a fan and an impeller.

Description of Related Art

An axial fan introduces airflow in a direction parallel to a rotation axis of an impeller, and pushes the airflow outward in the direction parallel to the rotation axis of the impeller. In detail, the axial fan is composed of the impeller and a frame, and the impeller is disposed in the frame. Limited by capability of a manufacturing process, there is a certain gap (for example, between 0.5 mm and 1 mm) between a blade tip of a blade and an inner wall of the frame, which is difficult to be further reduced, resulting in a fact that a backflow phenomenon generated at the blade tip of the blade cannot be significantly improved, which affects the performance of the axial fan.

SUMMARY

The invention provides a fan, which has excellent performance.

The invention provides an impeller, which helps improving performance of a fan.

The invention provides a fan including a frame and an impeller. The frame has an air inlet and an air outlet opposite to the air inlet. The impeller is disposed in the frame and includes a hub and multiple blades surrounding the hub. Each of the blades has a negative pressure surface facing the air inlet, a positive pressure surface facing the air outlet, a blade root connected to the hub, and a blade tip opposite to the blade root. In a first region extending from the blade root to the blade tip by a first length, the negative pressure surface and the positive pressure surface are respectively a convex arc surface and a plane. In a second region extending from the blade tip to the blade root by a second length smaller than the first length, the negative pressure surface and the positive pressure surface are respectively a convex arc surface and a concave arc surface or both convex arc surfaces. A sum of the first length and the second length is equal to a chord length between the blade root and the blade tip.

The invention provides an impeller including a hub and multiple blades surrounding the hub. Each of the blades has a negative pressure surface, a positive pressure surface opposite to the negative pressure surface, a blade root connected to the hub, and a blade tip opposite to the blade root. In a first region extending from the blade root to the blade tip by a first length, the negative pressure surface and the positive pressure surface are respectively a convex arc surface and a plane. In a second region extending from the blade tip to the blade root by a second length smaller than the first length, the negative pressure surface and the positive pressure surface are respectively a convex arc surface and a concave arc surface or both convex arc surfaces. A sum of the first length and the second length is equal to a chord length between the blade root and the blade tip.

Based on the above, by changing a geometric profile of the negative pressure surface and the positive pressure surface near the blade tip in the blade, in the blade near the blade tip, a pressure difference of the airflow between the negative pressure surface and the positive pressure surface may be reduced, which mitigates a phenomenon that the airflow flows back from the positive pressure surface to the negative pressure surface, thereby improving the performance of the fan.

In order for the aforementioned features and advantages of the disclosure to be more comprehensible, several embodiments accompanied with drawings are described in detail as follows.

DESCRIPTION OF THE EMBODIMENTS

Figure 1:
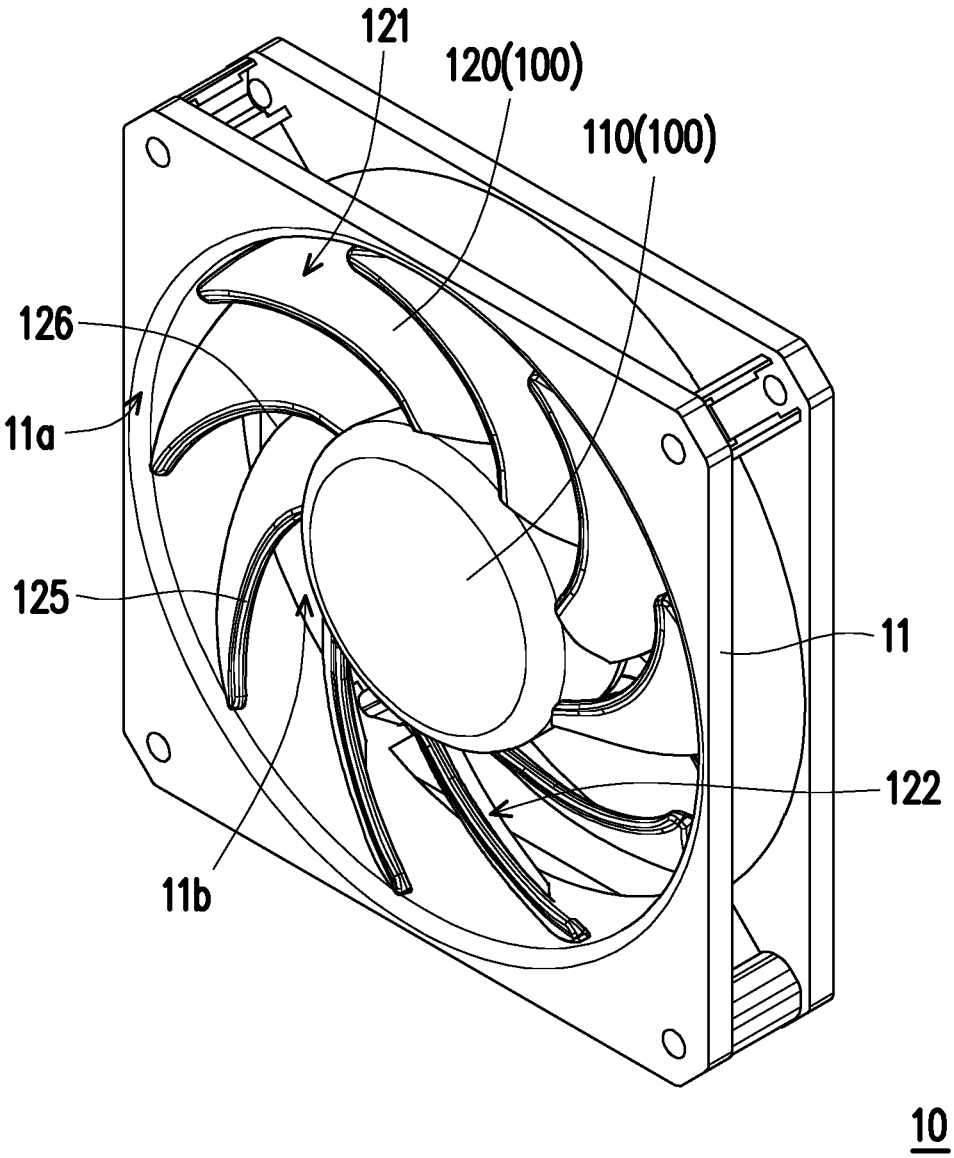
FIG. 1 is a schematic view of a fan according to an embodiment of the invention.
Figure 2:
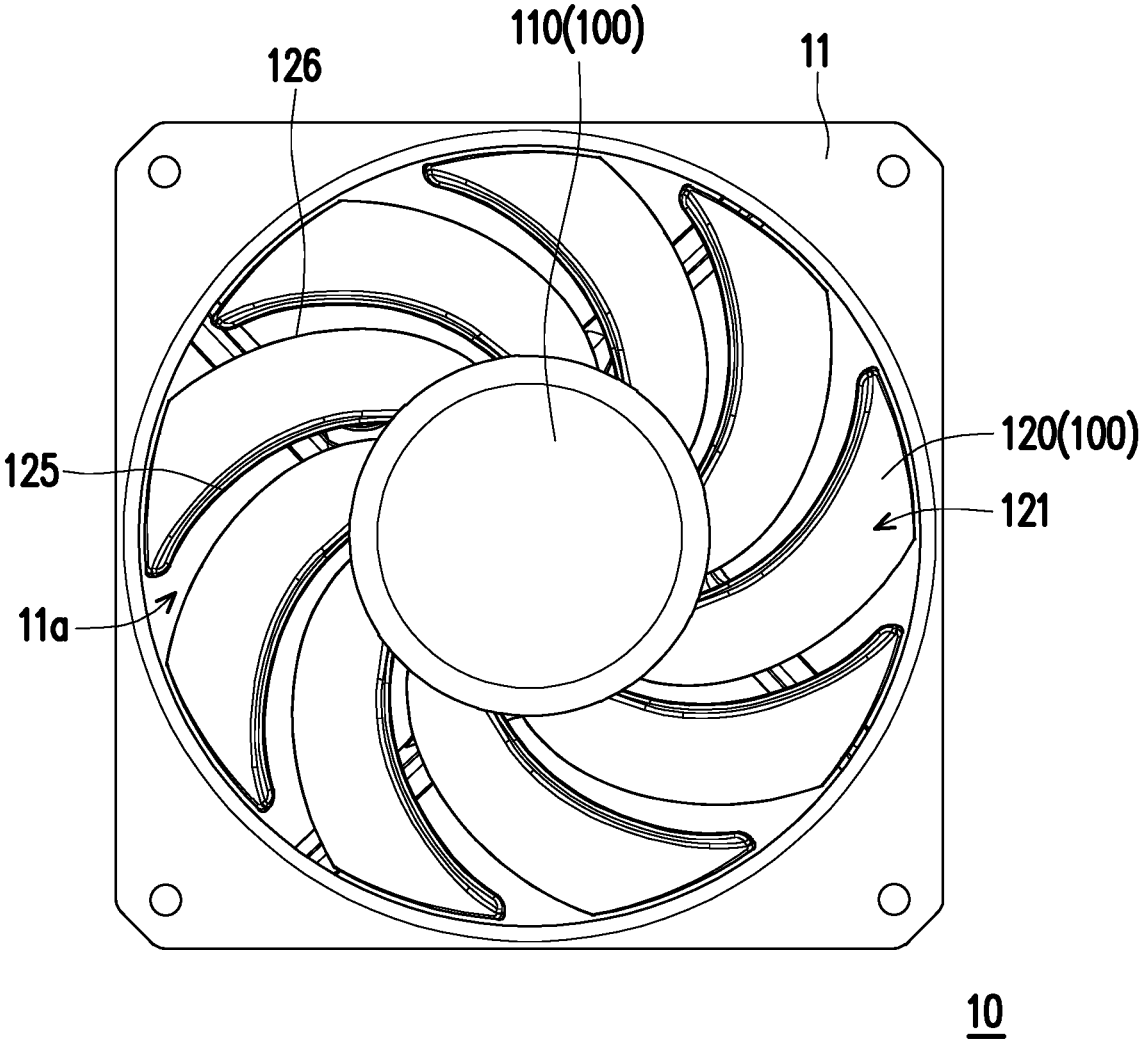
FIG. 2 is a schematic front view of the fan in FIG. 1.
Figure 3:
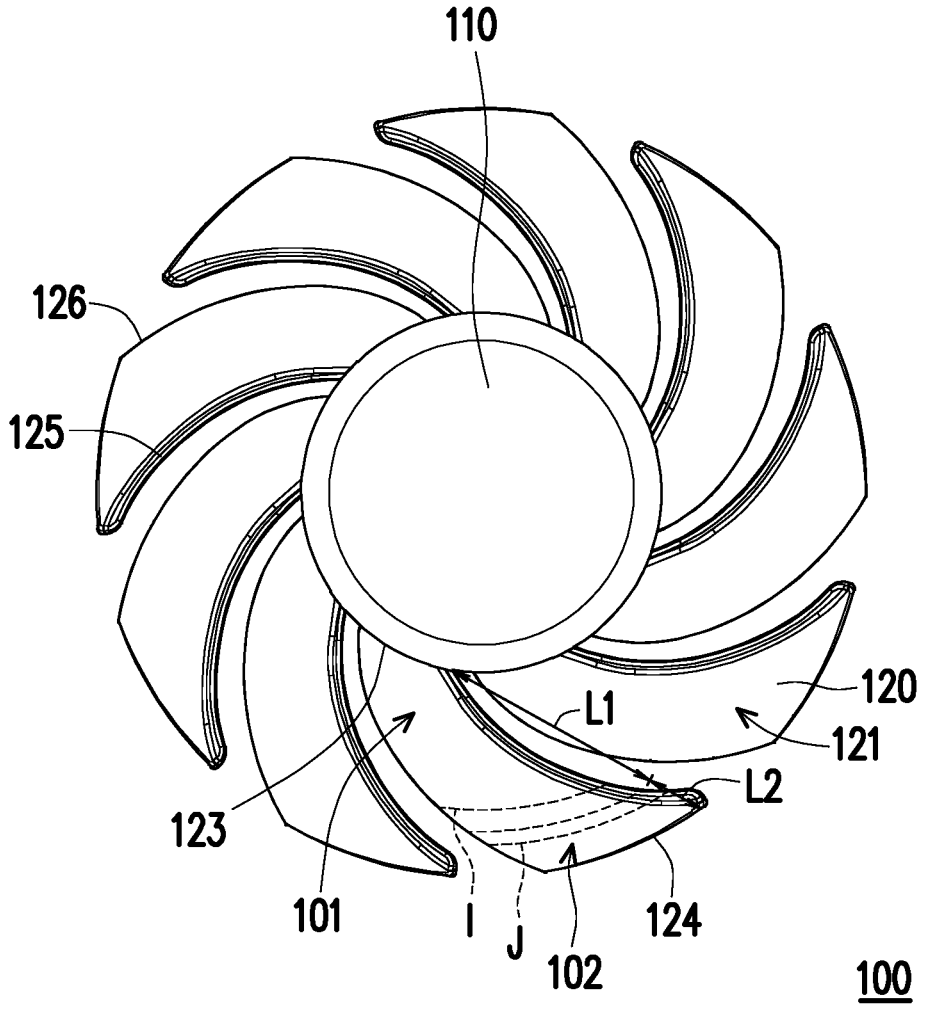
FIG. 3 is a schematic front view of an impeller in FIG. 2.

FIG. 1 is a schematic view of a fan according to an embodiment of the invention. FIG. 2 is a schematic front view of the fan in FIG. 1. FIG. 3 is a schematic front view of an impeller in FIG. 2. Referring to FIG. 1 to FIG. 3, in the embodiment, a fan 10 may be an axial fan and includes a frame 11 and an impeller 100. The frame 11 is used for accommodating the impeller 100, in other words, the impeller 100 is disposed in the frame 11 so as to rotate relative to the frame 11 around a rotation axis. Further, the frame 11 has an air inlet 11*a* and an air outlet 11*b* relative to the air inlet 11*a*. The impeller 100 in operation may introduce airflow from the air inlet 11*a* in a direction parallel to the rotation axis, and push the airflow outward from the air outlet 11*b* in the direction parallel to the rotation axis.

Figure 4A:
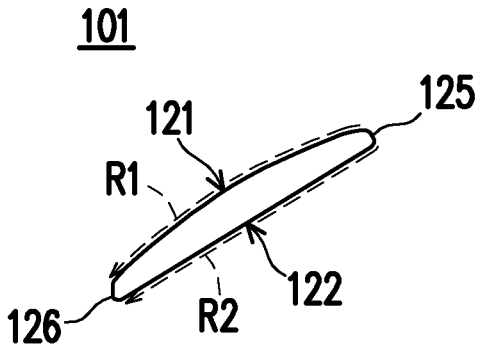
FIG. 4A and FIG. 4B are schematic views of cross-sectional profiles of a blade along a line segment I and a line segment J in FIG. 3 according to an example.
Figure 4B:
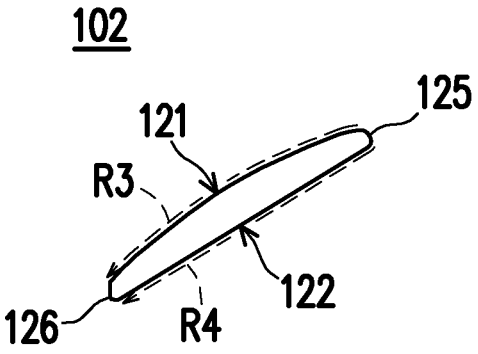

FIG. 4A and FIG. 4B are schematic views of cross-sectional profiles of a blade along a line segment I and a line segment J in FIG. 3 according to an example. As shown in FIG. 1, FIG. 3, FIG. 4A and FIG. 4B, the impeller 100 includes a hub 110 and multiple blades 120 surrounding the hub 110, and each blade 120 has a negative pressure surface 121, a positive pressure surface 122 opposite to the negative pressure surface 121, a blade root 123 connected to the hub 110 and a blade tip 124 opposite to the blade root 123. In each blade 120, the negative pressure surface 121 faces the air inlet 11*a*, and the positive pressure surface 122 faces the air outlet 11*b*.

As shown in FIG. 3, FIG. 4A and FIG. 4B, in the embodiment, each blade 120 has at least two different geometric profiles, for example, the geometric profile near the blade root 123 is different from the geometric profile near the blade tip 124. Further, each blade 120 may be divided into a first region 101 and a second region 102, where the first region 101 extends from the blade root 123 to the blade tip 124 by a first length L1, and the second region 102 extends from the blade tip 124 to the blade root 123 by a second length L2. A geometrical profile (for example, a cross-sectional profile) of each blade 120 in the first region 101 is different from a geometrical profile (for example, a cross-sectional profile) in the second region 102.

For example, a distance between a border of the first region 101 and the second region 102 and the blade tip 124 is a quarter of a chord length between the blade root 123 and the blade tip 124. On the other hand, a distance between the border of the first region 101 and the second region 102 and the blade root 123 is three quarters of the chord length between the blade root 123 and the blade tip 124. Namely, a sum of the first length L1 and the second length L2 is equal to the chord length between the blade root 123 and the blade tip 124, where the second length L2 is a quarter of the chord length between the blade root 123 and the blade tip 124, and the first length L1 is three quarters of the chord length between the blade root 123 and the blade tip 124.

As shown in FIG. 3 and FIG. 4A, in the first region 101, the negative pressure surface 121 may be a convex arc surface, and the positive pressure surface 122 may be a plane. The flow distance R1 of the airflow on the negative pressure surface 121 is greater than a flow distance R2 of the airflow on the positive pressure surface 122. Based on Bernoulli's principle, a flow velocity of the airflow on the negative pressure surface 121 is greater than a flow velocity of the airflow on the positive pressure surface 122, and a pressure of the airflow on the negative pressure surface 121 is greater than a pressure of the airflow on the positive pressure surface 122.

As shown in FIG. 3 and FIG. 4B, in the second region 102, the negative pressure surface 121 may be a convex arc surface, and the positive pressure surface 122 may be a concave arc surface. In detail, since an arc length of the negative pressure surface 121 is close to or equal to an arc length of the positive pressure surface 122, a flow distance R3 of the airflow on the negative pressure surface 121 is close to or equal to a flow distance R4 of the airflow on the positive pressure surface 122. Based on the Bernoulli's principle, the flow velocity of the airflow on the negative pressure surface 121 is close to or equal to the flow velocity of the airflow on the positive pressure surface 122, and the pressure of the airflow on the negative pressure surface 121 is close to or equal to the pressure of the airflow on the positive pressure surface 122. Therefore, in the second region 102 or in the blade 120 near the blade tip 124, a difference between the flow velocity of the airflow on the negative pressure surface 121 and the flow velocity of the airflow on the positive pressure surface 122 may be close zero or equal to zero, and a difference between the pressure of the airflow on the negative pressure surface 121 and the pressure of the airflow on the positive pressure surface 122 may be close to zero or equal to zero, so as to mitigate a phenomenon that the airflow flows back from the positive pressure surface 122 to the negative pressure surface 121, thereby improving the performance of the fan 10.

In detail, a difference between the flow distance R1 of the airflow on the negative pressure surface 121 and the flow distance R2 on the positive pressure surface 122 in the first region 101 is greater than a difference between the flow distance R3 of the airflow on the negative pressure surface 121 and the flow distance R4 on the positive pressure surface 122 in the second region 102. A difference between the flow velocity of the airflow on the negative pressure surface 121 and the flow velocity on the positive pressure surface 122 in the first region 101 is greater than a difference between the flow velocity of the airflow on the negative pressure surface 121 and the flow velocity on the positive pressure surface 122 in the second region 102. In addition, a difference between the pressure of the airflow on the negative pressure surface 121 and the pressure on the positive pressure surface 122 in the first region 101 is greater than a difference between the pressure of the airflow on the negative pressure surface 121 and the pressure on the positive pressure surface 122 in the second region 102.

As shown in FIG. 1, FIG. 3, FIG. 4A and FIG. 4B, each blade 120 has an air inlet end 125 corresponding to the air inlet 11*a* and an air outlet end 126 corresponding to the air outlet 11*b*. In the first region 101, the airflow flows a first distance (i.e. the flow distance R1) on the negative pressure surface 121 from the air inlet end 125 to the air outlet end 126, and flows a second distance (i.e. the flow distance R2) on the positive pressure surface 122 from the air inlet end 125 to the air outlet end 126. In the second region 102, the air flow flows a third distance (i.e. the flow distance R3) on the negative pressure surface 121 from the air inlet end 125 to the air outlet end 126, and flows a fourth distance (i.e. the flow distance R4) on the positive pressure surface 122 from the air inlet end 125 to the air outlet end 126.

In the first region 101, the first distance (i.e., the flow distance R1) is greater than the second distance (i.e., the flow distance R2). In the second region 102, since an arc length of the negative pressure surface 121 is close to or equal to an arc length of the positive pressure surface 122, the third distance (i.e., the flow distance R3) is close to or equal to the fourth distance (i.e., the flow distance R4). Therefore, the difference between the first distance (i.e., flow distance R1) and the second distance (i.e., flow distance R2) is greater than the difference between the third distance (i.e., flow distance R3) and the fourth distance (i.e., flow distance R4).

In the second area 102, a distance of the airflow flowing from the air inlet end 125 to the air outlet end 126 on the negative pressure surface 121 is close to or equal to a distance of the airflow flowing from the air inlet end 125 to the air outlet end 126 on the positive pressure surface 122. Based on the Bernoulli's principle, the flow velocity of the airflow on the negative pressure surface 121 is close to or equal to the flow velocity on the positive pressure surface 122, and the pressure of the airflow on the negative pressure surface 121 is close to or equal to the pressure on the positive pressure surface 122. Therefore, in the second region 102 or in the blade 120 near the blade tip 124, the pressure difference of the airflow on the negative pressure surface 121 and the positive pressure surface 122 may be close to zero or equal to zero, so as to mitigate the phenomenon that the airflow flows back from the positive pressure surface 122 to the negative pressure surface 121, thereby improving the performance of the fan 10.

Figure 5A:
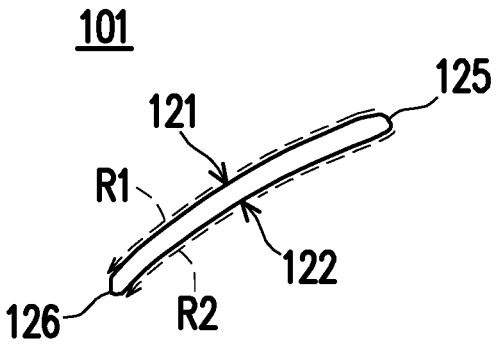
FIG. 5A and FIG. 5B are schematic views of cross-sectional profiles of a blade along the line segment I and the line segment J in FIG. 3 according to another example.
Figure 5B:
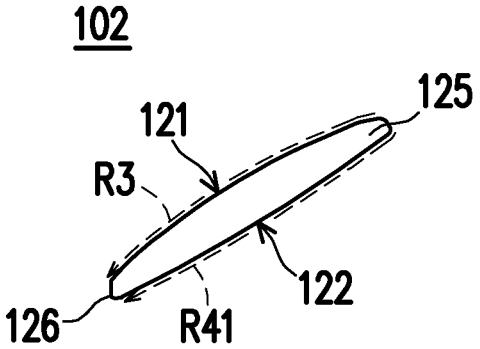

FIG. 5A and FIG. 5B are schematic views of cross-sectional profiles of a blade along the line segment I and the line segment J in FIG. 3 according to another example. A design principle of the example shown in FIG. 5A and FIG. 5B is the same or similar to that of the example shown in FIG. 4A and FIG. 4B, and differences between the two examples will be described below.

Referring to FIG. 3, FIG. 5A and FIG. 5B, in the second region 102, the negative pressure surface 121 and the positive pressure surface 122 are both convex arc surfaces, and the arc length of the negative pressure surface 121 is close to or equal to the arc length of the positive pressure surface 122. Namely, in the second region 102, the flow distance R3 of the airflow on the negative pressure surface 121 is close to or equal to the flow distance R4 on the positive pressure surface 122. Based on the Bernoulli's principle, in the second region 102, the flow velocity of the airflow on the negative pressure surface 121 is close to or equal to the flow velocity on the positive pressure surface 122, and the pressure of the airflow on the negative pressure surface 121 is close to or equal to the pressure on the positive pressure surface 122. Therefore, in the second region 102 or in the blade 120 near the blade tip 124, the pressure difference of the airflow on the negative pressure surface 121 and the positive pressure surface 122 may be close to zero or equal to zero, so as to mitigate the phenomenon that the airflow flows back from the positive pressure surface 122 to the negative pressure surface 121, thereby improving the performance of the fan 10.

In summary, by changing a geometric profile of the negative pressure surface and the positive pressure surface near the blade tip in the blade, in the blade near the blade tip, the flow distance of the airflow on the negative pressure surface is close to or equal to the flow distance of the airflow on the positive pressure surface, so that the pressure difference of the airflow between the negative pressure surface and the positive pressure surface may be reduced, which mitigate the phenomenon that the airflow flows back from the positive pressure surface to the negative pressure surface, thereby improving the performance of the fan.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A fan, comprising:

a frame having an air inlet and an air outlet opposite to the air inlet; and an impeller disposed in the frame, and comprising:

a hub; and a plurality of blades surrounding the hub, wherein each of the blades has a negative pressure surface facing the air inlet, a positive pressure surface facing the air outlet, a blade root connected to the hub, and a blade tip opposite to the blade root, in a first region extending from the blade root to the blade tip by a first length, the negative pressure surface and the positive pressure surface are respectively a convex arc surface and a plane, in a second region extending from the blade tip to the blade root by a second length smaller than the first length, the negative pressure surface and the positive pressure surface are respectively a convex arc surface and a concave arc surface or both convex arc surfaces, wherein a sum of the first length and the second length is equal to a chord length between the blade root and the blade tip.

2. The fan according to claim 1, wherein a difference between a flow velocity of an airflow on the negative pressure surface and a flow velocity on the positive pressure surface in the first region is greater than a difference between a flow velocity of the airflow on the negative pressure surface and a flow velocity on the positive pressure surface in the second region.

3. The fan according to claim 1, wherein a flow velocity of an airflow on the negative pressure surface is greater than a flow velocity on the positive pressure surface in the first region, and a flow velocity of the airflow on the negative pressure surface is equal to a flow velocity on the positive pressure surface in the second region.

4. The fan according to claim 1, wherein a difference between a pressure of an airflow on the negative pressure surface and a pressure on the positive pressure surface in the first region is greater than a difference between a pressure of the airflow on the negative pressure surface and a pressure on the positive pressure surface in the second region.

5. The fan according to claim 1, wherein a pressure of an airflow on the negative pressure surface is greater than a pressure on the positive pressure surface in the first region, and a pressure of the airflow on the negative pressure surface is equal to a pressure on the positive pressure surface in the second region.

6. The fan according to claim 1, wherein a difference between a flow distance of an airflow on the negative pressure surface and a flow distance on the positive pressure surface in the first region is greater than a difference between a flow distance of the airflow on the negative pressure surface and a flow distance on the positive pressure surface in the second region.

7. The fan according to claim 1, wherein a flow distance of an airflow on the negative pressure surface is greater than a flow distance on the positive pressure surface in the first region, and a flow distance of the airflow on the negative pressure surface is equal to a flow distance on the positive pressure surface in the second region.

8. The fan according to claim 1, wherein each of the blades has an air inlet end corresponding to the air inlet and an air outlet end corresponding to the air outlet, in the first region, an airflow flows a first distance on the negative pressure surface from the air inlet end to the air outlet end, and flows a second distance on the positive pressure surface from the air inlet end to the air outlet end, in the second region, the airflow flows a third distance on the negative pressure surface from the air inlet end to the air outlet end, and flows a fourth distance on the positive pressure surface from the air inlet end to the air outlet end, wherein a difference between the first distance and the second distance is greater than a difference between the third distance and the fourth distance.

9. The fan according to claim 8, wherein the first distance is greater than the second distance, and the third distance is equal to the fourth distance.

10. The fan according to claim 1, wherein the second length is a quarter of the chord length.

11. The fan according to claim 1, wherein the first length is three quarters of the chord length.

12. An impeller, comprising:

a hub; and a plurality of blades surrounding the hub, wherein each of the blades has a negative pressure surface, a positive pressure surface opposite to the negative pressure surface, a blade root connected to the hub, and a blade tip opposite to the blade root, in a first region extending from the blade root to the blade tip by a first length, the negative pressure surface and the positive pressure surface are respectively a convex arc surface and a plane, in a second region extending from the blade tip to the blade root by a second length smaller than the first length, the negative pressure surface and the positive pressure surface are respectively a convex arc surface and a concave arc surface or both convex arc surfaces, wherein a sum of the first length and the second length is equal to a chord length between the blade root and the blade tip.

* * * * *